US005819132A

United States Patent [19]

Hirobe

[11] Patent Number: 5,819,132

[45] **Date of Patent: *Oct. 6, 1998**

[54] IMAGE FORMING APPARATUS CAPABLE OF TONER REPLENISHMENT BASED ON DENSITY OF REFERENCE TONER IMAGE AND TONER REPLENISHMENT BASED ON RATIO OF TONER TO CARRIER

[75] Inventor: Fumitake Hirobe, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 671,844

[22] Filed: Jun. 28, 1996

[30] Foreign Application Priority Data

Jun. 29, 1995 [JP] Japan ..... 7-163673
Jul. 5, 1995 [JP] Japan ..... 7-169678

[51] Int. Cl.[6] ..... G03G 15/08

[52] U.S. Cl. ..... 394/49; 396/60

[58] Field of Search ..... 399/49, 58–62, 399/29

[56] References Cited

U.S. PATENT DOCUMENTS 5,057,870 10/1991 Aoki ..... 399/29
5,387,965 2/1995 Hasegawa et al. ..... 399/60

*Primary Examiner*—Joan H. Pendegrass
*Attorney, Agent, or Firm*—Fitzpatrick, Cella, Harper & Scinto

[57] ABSTRACT

An image forming apparatus is capable of toner replenishment based on density reference toner image and toner replenishment based on ration of toner to carrier. The apparatus is provided with an image carrier, a developing unit for developing the electrostatic image on the image carrier with developer of toner and carrier, replenishing unit for replenishing the toner to the developing unit, image density sensing unit for sensing a density of the developed toner image, ration sensing unit for sensing a ratio of the toner to the carrier in the developing unit, and selecting unit for selecting one of first toner replenishment in which an amount of toner based on a sensing output from the image density sensing unit is replenished, and second toner replenishment in which an amount of toner based on a sensing output from the ratio sensing unit is replenished.

4 Claims, 9 Drawing Sheets

IMAGE FORMING APPARATUS CAPABLE OF TONER REPLENISHMENT BASED ON DENSITY OF REFERENCE TONER IMAGE AND TONER REPLENISHMENT BASED ON RATIO OF TONER TO CARRIER

BACKGROUND OF THE INVENTION

1. Field of the Invention

The present invention relates to an image forming apparatus such as a printer and, more particularly, to an image forming apparatus which uses a two-component developer containing toner and carrier.

2. Related Background Art

FIG. 3 is a sectional view of a two-component developing apparatus.

As shown in FIG. 3, a developer is supplied to the surface of a developing sleeve 3 as a developer carrier by developer agitating conveyor means 11 and 12 while being held in the state of a magnetic brush by the magnetic force of a magnet roller 10. The developer is conveyed by the rotation of the developing sleeve 3 to a development area in a portion opposing a photosensitive drum 4 as an image carrier. At the same time, the heads of the magnetic brush are cut by a returning member 1 for regulating the developer amount on the developing sleeve and a blade 2 as a brush height regulating member. Consequently, the amount of the developer conveyed to the development area can be maintained at a proper amount.

More specifically, the interior of a developing unit 9 is partitioned into a developing chamber 16 and an agitating chamber 17 by a partition 6 which extends vertically. The developing chamber 16 and the agitating chamber 17 house a two-component developer containing nonmagnetic toner and a magnetic carrier.

As described above, the first and second screw-type developer agitating conveyor means 11 and 12 are arranged in the developing chamber 16 and the agitating chamber 17, respectively. The first agitating conveyor means 11 agitates and conveys the developer in the developing chamber 16. The second agitating conveyor means 12 agitates and conveys, under the control of a developer density control unit, toner supplied from a toner replenishment tank (not shown) to the upstream side of this second agitating conveyor means 12 and the developer already existing in the agitating chamber 17, thereby making the toner density uniform. Developer passages (not shown) are formed in the end portions on the front and the back sides (in FIG. 7) of the partition 6 to allow the developing chamber 16 and the agitating chamber 17 to communicate with each other. By the conveying forces of the first and second agitating conveyor means 11 and 12, the developer in the developing chamber 16 whose toner density is lowered because the toner is consumed in development, is moved into the agitating chamber 17 through the passages.

As shown in FIG. 4, the first screw-type agitating conveyor means 11 is arranged, substantially parallel with the axial direction of the developing sleeve 3, i.e., the development widthwise direction, on the bottom of the developing chamber 16. This screw structure is formed by spirally forming a blade member around a rotating shaft. The first agitating conveyor means 11 rotates to convey the developer in the developing chamber 16 in one direction, along the axial direction of the developing sleeve 3, on the bottom of the developing chamber 16. The second agitating conveyor means 12 also has a screw structure (in which a blade member is spirally formed around a rotating shaft in a direction opposite to the direction of the first agitating conveyor means 11) identical with the structure of the first screw-type agitating conveyor means 11. The second agitating conveyor means 12 is arranged on the bottom of the agitating chamber 17 so as to be substantially parallel to the first agitating conveyor means 11. The second agitating conveyor means 12 rotates in the same direction as the first agitating conveyor means 11 and conveys the developer in the agitating chamber 17 in a direction opposite to the direction of the first agitating conveyor means 11. Consequently, the developer is circulated between the developing chamber 16 and the agitating chamber 17 by the rotations of the first and the second agitating conveyor means 11 and 12.

In this circulation of the developer, a developer density sensing means 18 is conventionally provided near the developing sleeve 3 on the front side in the thrust direction in the developing chamber 16. The toner density sensing means 18 is provided on the front side, rather than the back side, for the reasons explained below. If the toner density sensing means 18 is provided on the back side (i.e., on the upstream side of the developer circulation in the developing chamber 16), a decrease in the toner density cannot be sensed when toner is consumed on the downstream side. When the toner density sensing means 18 is provided on the front side, however, the sensing position is on the downstream side in the thrust direction in the developing chamber 16. Accordingly, a decrease in the toner density can be sensed regardless of the position in the thrust direction where toner is consumed.

The above method (to be referred to as developer reflection ATR hereinafter) of replenishing toner by optically sensing the ratio of the toner to the carrier in the developing chamber 16 by using the difference between the reflectances of the carrier and the toner is effective in a developing unit in which the difference between the reflectances of the toner and the carrier is large.

As another toner replenishment method, there is a method (to be referred to as patch sensing ATR hereinafter) by which a patch latent image with a certain gradation level is actually formed on the photosensitive drum 4, whether toner is excess or lacking is checked on the basis of the density of a patch image obtained by developing the patch latent image, and a necessary amount of toner is replenished.

This method is effective when the difference between the reflectances of the toner and the carrier is small.

Unfortunately, the developer reflection ATR and the patch sensing ATR described above have the following problems.

The developer reflection ATR is usually operated at a predetermined timing during copying and can estimate the developer density in a developing unit at that timing. However, when originals are switched from a low-consumption one to a high-consumption one, or vice versa, i.e., when originals are switched from a high-consumption one to a low-consumption one, the method undershoots or overshoots.

The state of these undershoots and overshoots is indicated by the solid line in FIG. 5. In FIG. 5, the abscissa indicates the copy count and the ordinate indicates the toner density, with respect to the initial toner density, of the developer on the sleeve 3 in the developing unit. The minus sign (–) indicates a direction in which the toner density decreases, and the plus sign (+) indicates a direction in which the toner density increases. The copy count is 0 when a solid white original is switched to a solid black original. These undershoots and overshoots are caused by a time lag before the density is sensed by the developer density sensing means 18.

Also, even if the ratio of the toner to the carrier is held constant by the developer reflection ATR, the density of the developed toner image often varies due to deterioration of the carrier or environmental changes.

In the patch sensing ATR, a patch image 28 with a certain density level is actually formed on the photosensitive drum 4 and sensed by an image density sensing means 19. This results in a long copy sequence. Also, if image density goes down occurs due to an increase (to be abbreviated as charge up hereinafter) in the charge amount (to be abbreviated as tribo hereinafter) supplied from a magnetic carrier to toner, toner excess replenishment takes place and this causes developer overflow. If, in contrast, image density goes up occurs due to a decrease in the tribo, the state of toner replenishment stop continues to result in a significant lack of the developer coated amount on the developing sleeve 3, leading to degradation of an image.

SUMMARY OF THE INVENTION

It is an object of the present invention to provide an image forming apparatus capable of reducing overshoot and undershoot and stabilizing the toner density.

It is another object of the present invention to provide an image forming apparatus capable of changing the ratio of toner to a carrier in accordance with deterioration of the carrier or an environmental change.

It is still another object of the present invention is to provide an image forming apparatus comprising an image carrier for carrying an electrostatic latent image, a developing unit for developing the electrostatic latent image on the image carrier with a developer consisting of toner and a carrier, replenishing means for replenishing the toner to the developing unit, image density sensing means for sensing a density of the developed toner image, ratio sensing means for sensing a ratio of the toner to the carrier in the developing unit, and selecting means for selecting one of first toner replenishment in which toner whose amount is based on a sensing output from the image density sensing means is replenished and second toner replenishment in which toner whose amount is based on a sensing output from the ratio sensing means is replenished.

It is still another object of the present invention to provide an image forming apparatus comprising an image carrier for carrying an electrostatic latent image, a developing unit for developing the electrostatic latent image on the image carrier with a developer consisting of toner and a carrier, ratio sensing means for sensing a ratio of the toner to the carrier in the developing unit, replenishing means for replenishing the toner to the developing unit on the basis of an output from the ratio sensing means so that the ratio of the toner to the carrier equals a predetermined target value, density sensing means for sensing a density of a developed reference toner image, and determining means for determining the target value on the basis of the density sensed by the density sensing means.

Other objects and advantages of the invention will become apparent from the following detailed description taken in conjunction with the appended claims.

DESCRIPTION OF THE PREFERRED EMBODIMENTS

Embodiments of the present invention will be described below.

Figure 1:
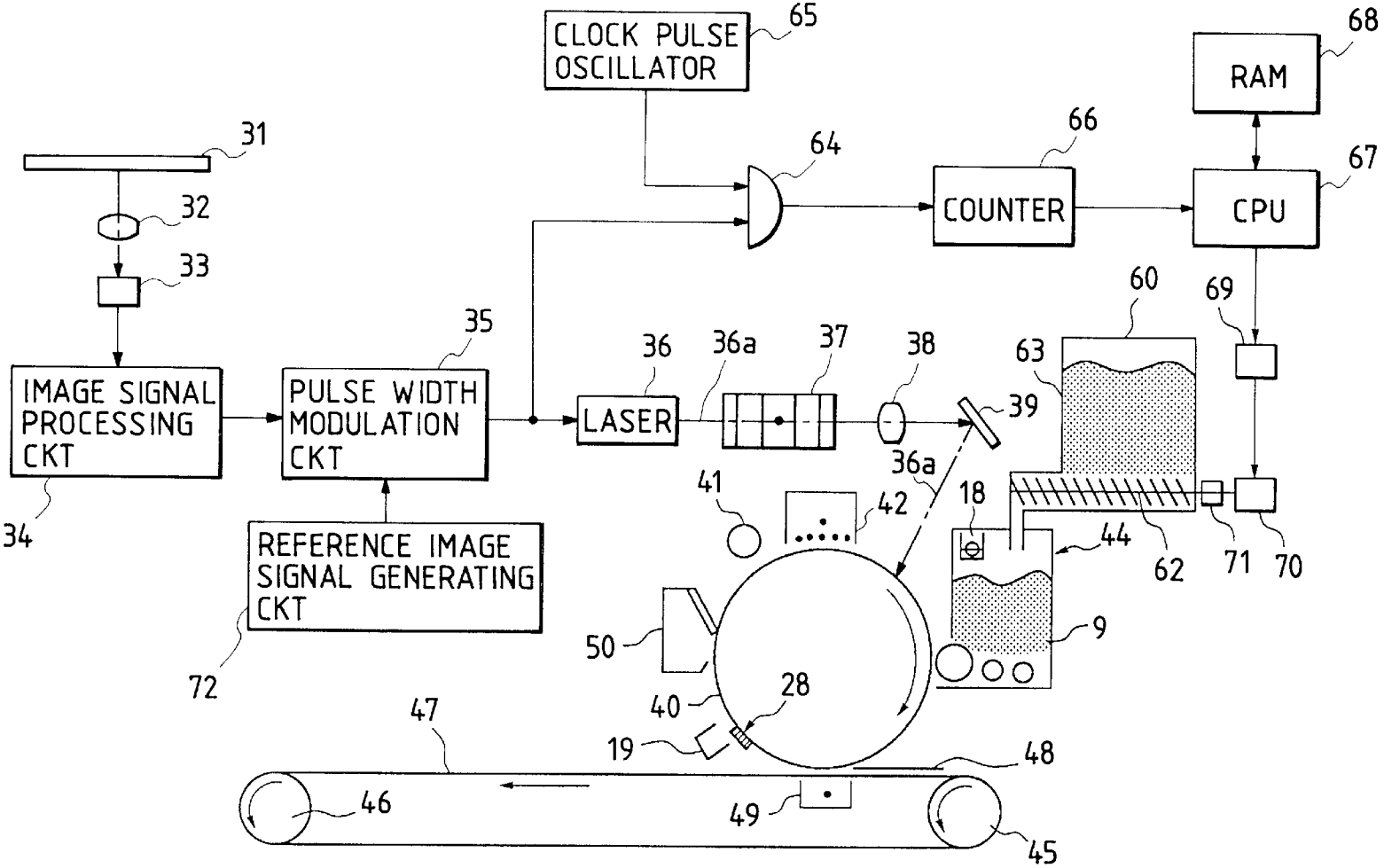
FIG. 1 is a view showing the construction of an image forming apparatus according to one embodiment of the present invention.

FIG. 1 is a schematic view of an electrophotographic digital copying machine as an image forming apparatus using a developing apparatus according to one embodiment of the present invention.

In the electrophotographic digital copying machine shown in FIG. 1, an image of an original 31 to be copied is projected on an image pickup device 33 such as a CCD by a lens 32. This image pickup device 33 decomposes the original image into a large number of pixels and generates optically converted signals corresponding to the densities of the individual pixels. The output analog image signals from the image pickup device 33 are sent to an image signal processing circuit 34. The image signal processing circuit 34 converts the analog image signals into pixel image signals having output levels corresponding to the densities of the individual pixels and sends the signals to a pulse width modulation circuit 35.

Figures 2A, 2B, 2C, 2D:
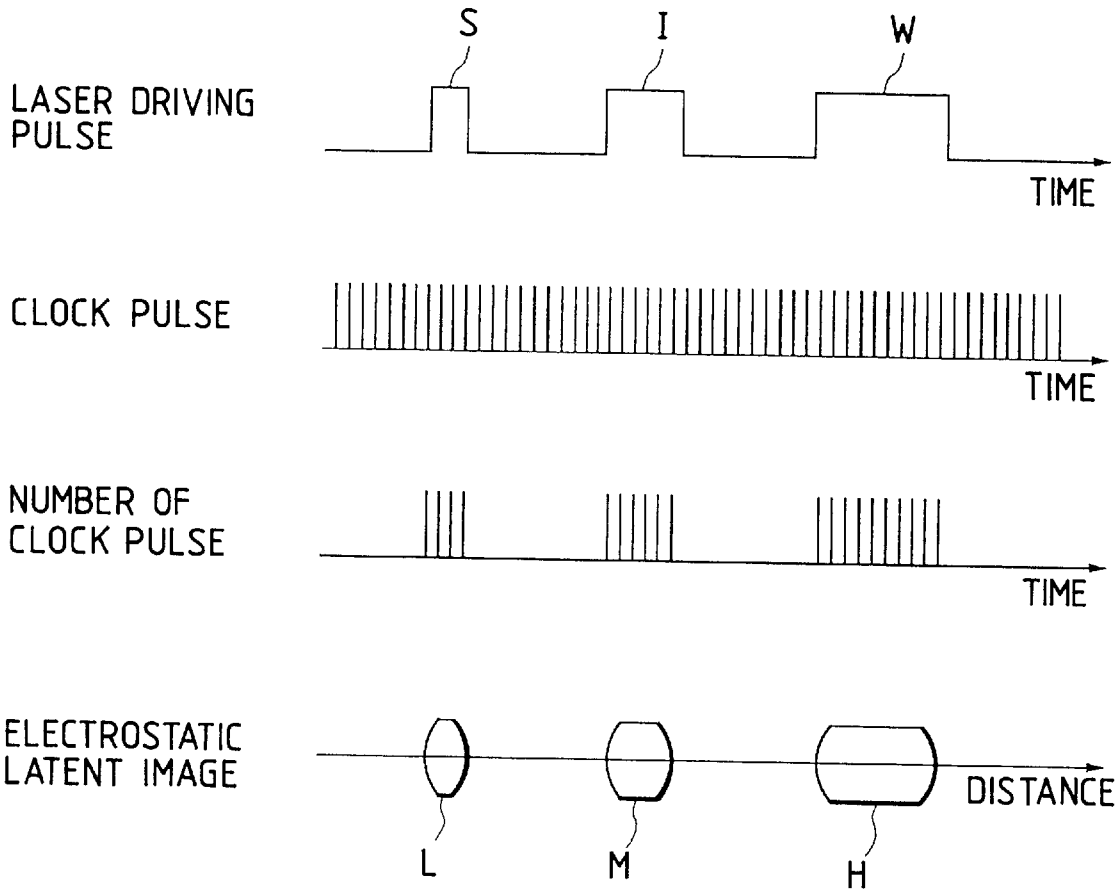
FIGS. 2A to 2D are timing charts for explaining a method of counting density information of an image information signal in the image forming apparatus in FIG. 1.

For each input pixel image signal, the pulse width modulation circuit 35 forms and outputs a laser driving pulse with a width (time length) corresponding to the level. That is, as illustrated in FIG. 2A, the pulse width modulation circuit 35 forms a wide driving pulse W for a high-density pixel image signal, a narrow driving pulse S for a low-density pixel image signal, and a driving pulse I with an intermediate width for a medium-density pixel image signal.

The output laser driving pulses from the pulse width modulation circuit 35 are supplied to a semiconductor laser 36, which emits light for a time corresponding to each pulse width. Accordingly, the semiconductor laser 36 is driven for a long time for a high-density pixel and a short time for a low-density pixel. Therefore, a photosensitive drum 40 as an image carrier is exposed over a long range in the main scan direction for a high-density pixel, and over a short range in the main scan direction for a low-density pixel, by an optical system to be described next. That is, the dot size of an electrostatic latent image changes in accordance with the density of each pixel. Accordingly, the toner consumption amount for a high-density pixel is naturally larger than that for a low-density pixel. In FIG. 2D, electrostatic latent images of low-, medium- and high-density pixels are indicated by reference symbols L, M, and H, respectively.

A laser beam 36*a* emitted from the semiconductor laser 36 is swept by a rotary polygon mirror 37, and a spot image of the laser beam 36*a* is formed on the photosensitive drum 40 as an image carrier by a fixed mirror 39 which points a lens 38 such as an f/θ lens and the laser beam 36*a* in the direction of the photosensitive drum 40. Consequently, the laser beam 36*a* scans the photosensitive drum 40 in a direction (the main scan direction) nearly parallel with the rotating axis of the rotary drum of the photosensitive drum 40, forming an electrostatic latent image on it.

The photosensitive drum 40 is an electrophotographic photosensitive body having a photosensitive layer, e.g., an amorphous silicon layer, a selenium layer, or an OPC layer, on the surface and rotates in a direction indicated by the arrow in FIG. 1. After being uniformly charged-removed by a pre-exposure unit 41, the photosensitive drum 40 is uniformly charged by a primary charger 42. Thereafter, the photosensitive drum 40 is exposed and scanned by the laser beam modulated in accordance with the image information signal to form an electrostatic latent image corresponding to the image signal. This electrostatic latent image is reversely developed into a visual image (toner image) by a developing unit 9 using a two-component developer consisting of toner and carrier particles. The reversal development is to visualize a region of a photosensitive body exposed to light by depositing toner charged to have the same polarity as that of a latent image on the region. The apparatus further comprises a hopper 60 for containing toner, a replenishing screw 62 for replenishing toner to a developing vessel, and a driving motor 70. This toner image is transferred by a transfer charger 49 onto a transfer medium 48 held on a transfer medium carrier belt 47 which is looped between two rollers 45 and 46 and endlessly driven in a direction indicated by the arrow in FIG. 1.

The transfer medium 48 on which the toner image is transferred is separated from the transfer medium carrier belt 47 and conveyed to a fixing unit (not shown) where the toner image is fixed into a permanent image. Any toner remaining on the photosensitive drum 40 after the transfer is removed by a cleaner 50.

Note that only a single image forming station (including the photosensitive drum 40, the primary charger 42, the developing unit 9, and the like components) is illustrated in FIG. 1 for the sake of simplicity. In the case of a color image forming apparatus, however, image forming stations corresponding to, e.g., cyan, magenta, yellow, and black, are sequentially arranged on the transfer medium carrier belt 47 along its moving direction. Electrostatic latent images of these different colors obtained by color-separating the image of an original are sequentially formed on photosensitive drums in the individual image forming stations. These electrostatic latent images are developed by developing units having the respective corresponding color toner components and sequentially transferred onto a transfer medium 48, which is held and conveyed by the transfer medium carrier belt 47.

Figure 6:
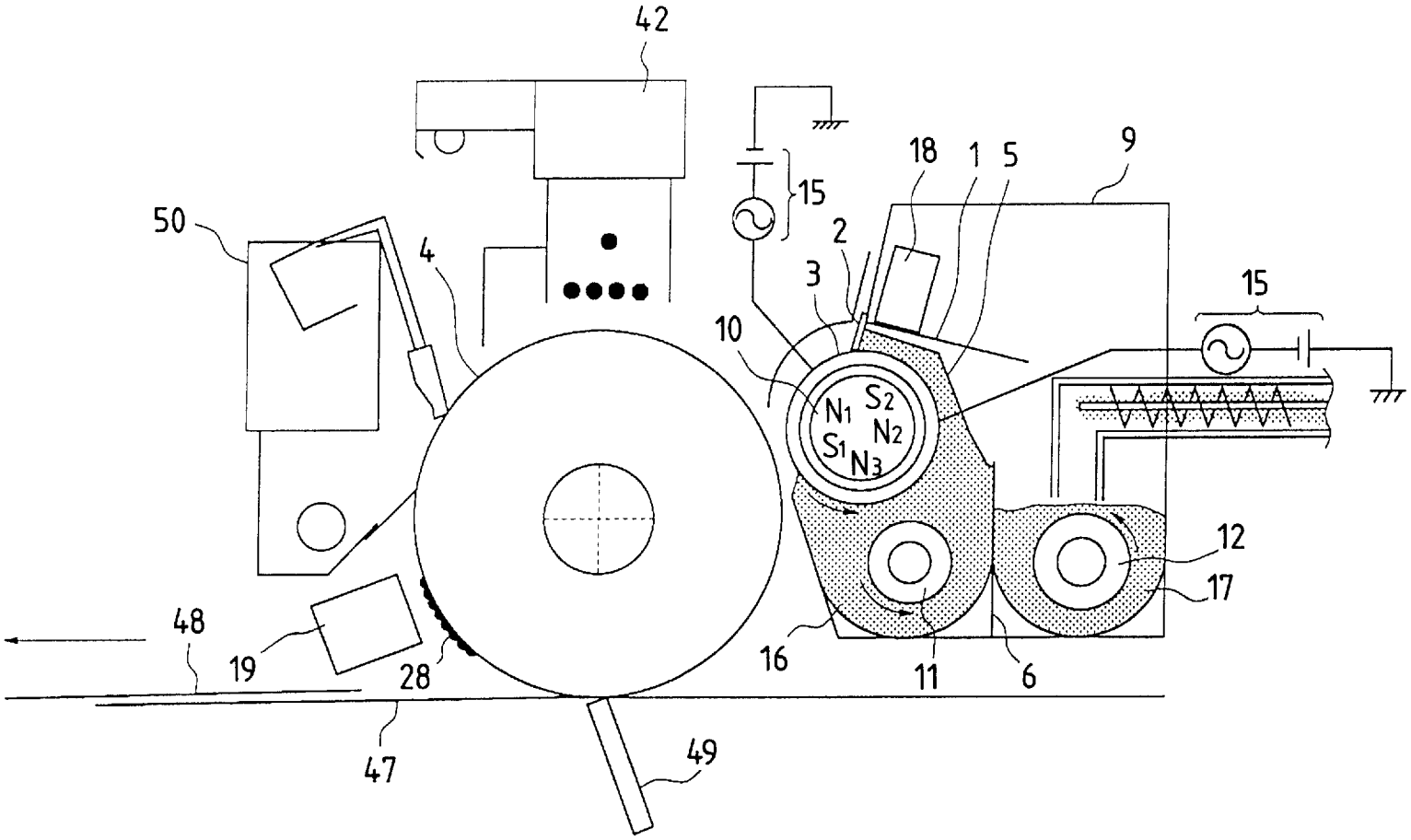
FIG. 6 is a view showing devices around a photosensitive drum in the image forming apparatus in FIG. 1.

FIG. 6 shows the details of the developing unit 9.

As in FIG. 6, the two-component developing apparatus 9 arranged to oppose a photosensitive drum 4 comprises a developing sleeve 3 as a developer carrier, a returning member 1 which regulates the amount of a developer which is drawn up from the developer, supply position to the head cutting position, a blade 2 as a developer head regulating member, and a toner density sensing means 18 as a ratio sensing means which optically senses the ratio of the toner to the carrier in a developing chamber 16.

A patch latent image formed on the photosensitive drum 4 in accordance with a reference density is developed into a patch image by the developing unit.

The patch image passes through the transfer unit without being transferred, and the density of the image is sensed by an image density sensing means 19.

The developing apparatus 9 will be described in more detail below.

The interior of the developing apparatus 9 is partitioned into the developing chamber 16 and an agitating chamber 17 by a partition 6, which extends vertically. The portion above the partition 6 is open, and an excess two-component developer in the developing chamber 16 is collected in the agitating chamber 17. The developing chamber 16 and the agitating chamber 17 contain a two-component developer consisting of nonmagnetic toner and a magnetic carrier.

First and second screw-type developer agitating conveyor means 11 and 12 are arranged in the developing chamber 16 and the agitating chamber 17, respectively. The first agitating conveyor means 11 agitates and conveys the developer in the developer chamber 16. The second agitating conveyor means 12 agitates and conveys, under the control of a developer density control unit, toner supplied from a toner replenishment tank (not shown) to the upstream side of this second agitating conveyor means 12 and the developer already existing in the agitating chamber 17, thereby making the toner density uniform. Developer passages (not shown) are formed in the end portions on the front and the back sides (in FIG. 1) of the partition 6 to allow the developing chamber 16 and the agitating chamber 17 to communicate with each other. By the conveying forces of the first and second agitating conveyor means 11 and 12, the developer in the developing chamber 16 whose toner density is lowered because the toner is consumed in development is moved into the agitating chamber 17 through the passages.

An opening is formed in a position, corresponding to a development area facing the photosensitive drum 4, of the developing chamber 16 of the developing apparatus 9. The developing sleeve 3 is rotatably arranged to be partially exposed to this opening. The developing sleeve 3 is made from a nonmagnetic material and rotates in a direction indicated by the arrow in FIG. 6 during development. A magnet 10 as magnetic field generating means is fixed in the developing sleeve 3. The developing sleeve 3 carries and conveys a layer of the two-component developer whose thickness is regulated by the blade 2, and, in the development area opposing the photosensitive drum 4, supplies the developer to the photosensitive drum 4, thereby developing a latent image. To increase the development efficiency, i.e., the supply efficiency of toner to the latent image on the photosensitive drum, a power supply 15 applies a developing bias voltage which is a superposed voltage of a DC voltage and an AC voltage to the developing sleeve 3.

In this embodiment, the magnet 10 has a developing magnetic pole $S_1$ and magnetic poles $N_1$, $S_2$, $N_2$, and $N_3$ for conveying the developer. The blade 2 is made from a nonmagnetic material such as aluminum (Al) and arranged upstream of the photosensitive drum 4 in the rotating direction of the developing sleeve 3. By adjusting the gap between the blade 2 and the surface of the developing sleeve 3, the blade 2 regulates the thickness of the developer conveyed on the developing sleeve 3 to the development area. In this embodiment, therefore, both the nonmagnetic toner and the magnetic carrier are supplied to the development area through the gap between the edge of the blade 2 and the developing sleeve 3.

The first screw-type agitating conveyor means 11 is arranged, substantially parallel with the axial direction of the developing sleeve 3, i.e., the development widthwise direction, on the bottom of the developing chamber 16. In this embodiment, this screw structure is formed by spirally forming a blade member around a rotating shaft. The first agitating conveyor means 11 rotates to convey the developer in the developing chamber 16 in one direction, along the axial direction of the developing sleeve 3, on the bottom of the developing chamber 16. The second agitating conveyor means 12 also has a screw structure (in which a blade member is spirally formed around a rotating shaft in a direction opposite to the direction of the first agitating conveyor means 11) identical with the structure of the first screw-type agitating conveyor means 11. The second agitating conveyor means 12 is arranged on the bottom of the agitating chamber 17 so as to be substantially parallel with the first agitating conveyor means 11. The second agitating conveyor means 12 rotates in the same direction as that of the first agitating conveyor means 11 and conveys the developer in the agitating chamber 17 in a direction opposite to the direction of the first agitating conveyor means 11. Consequently, the developer is circulated between the developing chamber 16 and the agitating chamber 17 by the rotations of the first and the second agitating conveyor means 11 and 12.

The developer in the developing chamber 16 is carried to the developing sleeve 3 by the action of the magnet 10 incorporated into the developing sleeve 3. The developer whose layer thickness is regulated by the blade 2, is conveyed to the development area. The developer which remains without being used in the development in the development area is again conveyed to the developing chamber 16 by the developing sleeve 3. The developer is scraped down from the developing sleeve 3 by the repulsion magnetic poles $N_2$ and $N_3$ and collected into the developing chamber 16.

On the other hand, the developer, which is agitated and conveyed by the rotation of the first agitating conveyor means 11 is drawn up in the direction of the developing sleeve 3 by the magnetic pole $N_2$ as one of the repulsion magnetic poles. The amount of the developer drawn up and conveyed to the developing sleeve 3 is regulated to a certain degree by the returning member 1.

The developer drawn up by the magnetic pole $N_2$ is conveyed to the blade unit by a magnetic constraining force which is formed by the magnetic field from the magnetic pole $S_2$, which acts in the direction of the center of the developing sleeve 3, and which is determined by the developer amount regulated by the returning member 1, and by a conveying force acting in the rotating direction of the developing sleeve 3.

The developer density sensing means 18 is incorporated into the returning member 1 at a position between the draw-up position of the developer and the blade unit, at which the developer density sensing means 18 opposes a portion of the developing sleeve 3 between the magnetic poles $N_2$ and $S_2$.

Figure 7:
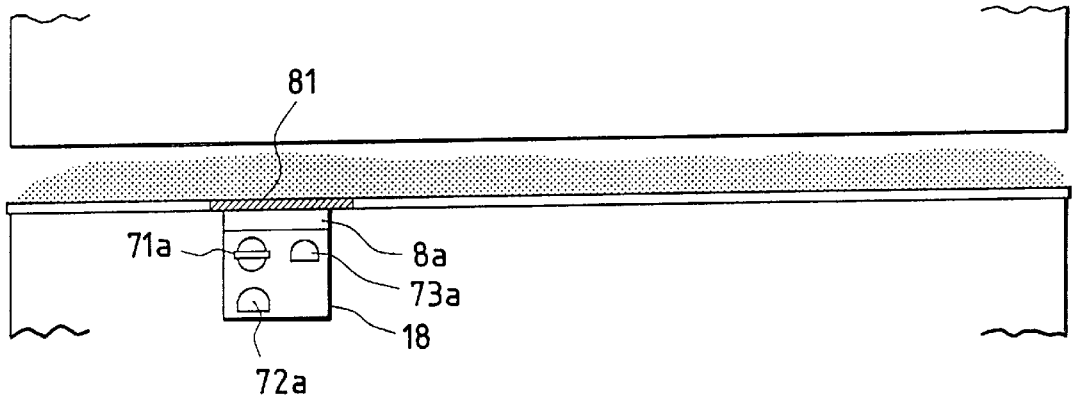
FIG. 7 is a view showing a sensor for sensing the toner density.

As shown in FIG. 7, the toner density sensing means 18 of this embodiment is a developer reflection type toner density sensing means comprising a bidirectional emission type LED 71*a*, a light-receiving element 72*a* for reference light, a light-receiving element 73*a* for reflected light, and a detection window 8*a*. This detection window 8*a* is made of a transparent acrylic resin. A PFA sheet 81 is stuck to the detection surface, facing the developer, of the detection window 8*a* so as to cover the detection surface, in order to prevent adhesion of toner.

The nonmagnetic toner used in this embodiment consists of toner particles with an average particle size of 5 to 11 $\mu$m, formed by dispersing 80 to 90 wt % of a polyester resin, 5 to 15 wt % of a coloring pigment, and a metal complex of alkyl-substituted salicylic acid as a negative charge controlling agent. The toner is externally added with 0.2 to 2 wt % of titanium oxide $TiO_2$. Silica also can be used as the external additive.

As the magnetic carrier, optional ferrite carrier particles, particularly sintered ferrite particles are used. That is, any of Zn ferrite, Ni ferrite, Cu ferrite, Mn—Zn ferrite, Mn—Mg ferrite, Cu—Zn ferrite, and Ni—Zn ferrite is used as a core material, and particles of this core material are coated with 0.5 to 2 wt % of an acrylic resin in order to improve the triboelectrification property, the environmental stability, and the durability, thereby forming carrier particles with an average particle size of 30 to 60 $\mu$m. As the coating agent it is also possible to properly, selectively use, e.g., a polyester resin, a fluorine resin, and a silicone resin.

The developer density sensing means for sensing the ratio of the toner to the carrier is provided on the front side (18 in FIG. 7) in the thrust direction in the developing vessel. This developer density sensing means 18 uses the characteristic that the toner in the two-component developer reflects infrared light and the carrier absorbs infrared light. That is, the developer density sensing means 18 emits infrared light onto the developer in the developing vessel, and the amount of the reflected infrared light is monitored by the light-receiving element 73*a*. On the basis of the monitoring result, the toner density of the two-component developer is calculated and toner is replenished to stably maintain the toner density.

The toner replenishment density is controlled as follows. First, the two-component developer is placed in the developing vessel, the amount of reflected light form the two-component developer not in use is monitored, and a corresponding output Sig-init from the light-receiving element 73*a* is measured. The measured value is stored in a memory of the main body. When copying is started and the two-component developer is started to be used, the reflected light amount from the two-component developer is monitored each time a copy is formed, and a corresponding output Sig-cur from the light-receiving element 73*a* is measured. A difference ΔSig between this output Sig-cur and the output Sig-init stored in the memory is calculated.

$$\Delta Sig=(Sig\text{-}init)-(Sig\text{-}cur) \quad (1)$$

On the basis of Equation (1) and an output sensitivity value "rate" which is previously measured per a variation of 1 wt % in the toner density, a difference ΔD of the current toner density from the initial toner density is calculated.

$$\Delta D=\Delta Sig/rate \quad (2)$$

The toner amount to be replenished into the developing vessel is determined from the calculated value of ΔD. That is, if the difference from the initial toner density is a negative value, a toner amount meeting the difference is replenished. If the difference is a positive value, the replenishment is stopped. For example, if ΔD=−1 wt %, toner equivalent to 1 wt % is replenished. If ΔD=+1 wt %, no replenishment is performed. In this way control is performed to maintain the initial toner density.

The image density sensing means 19 will be described below.

Figure 3:
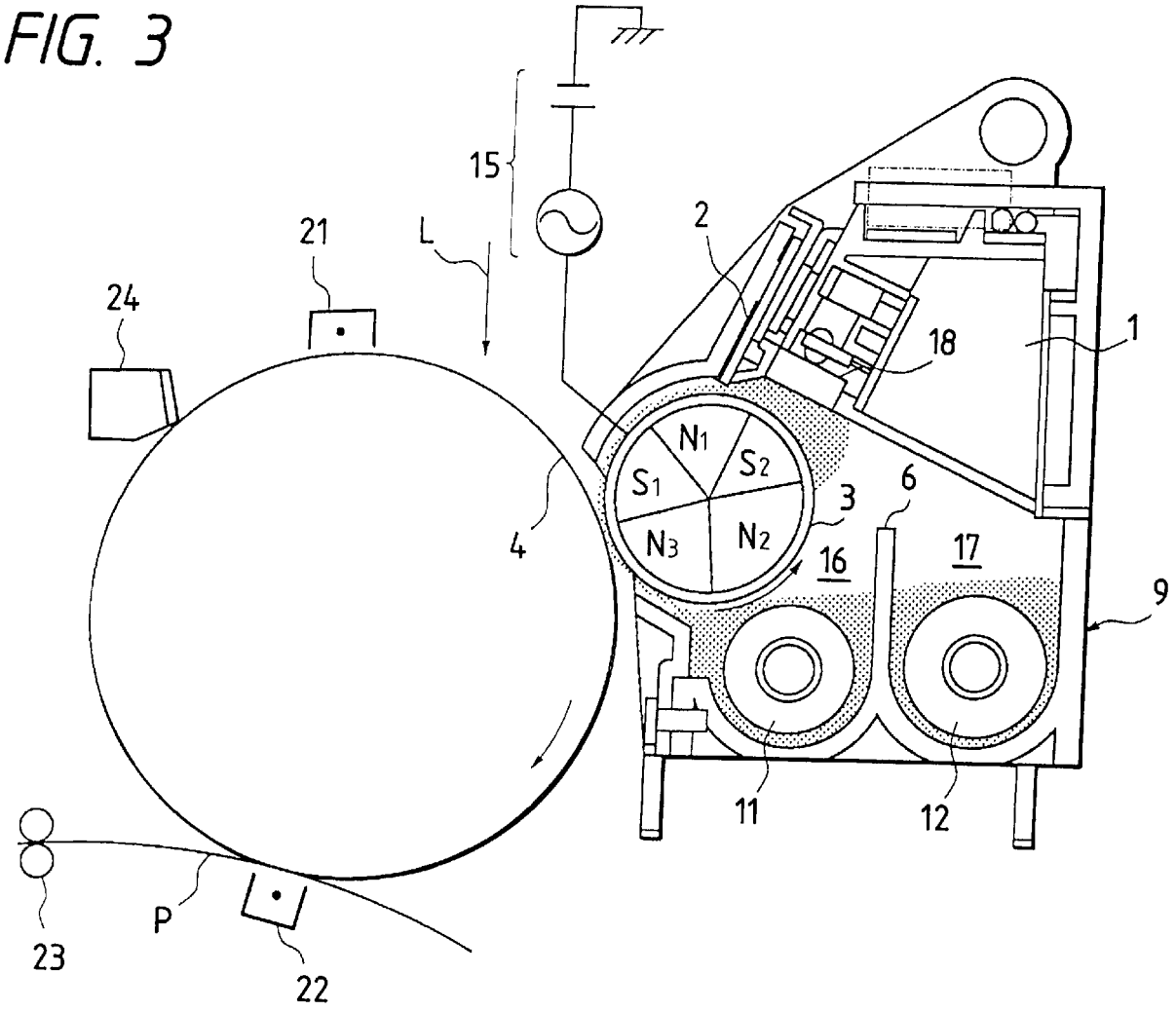
FIG. 3 is a sectional view showing a two-component developing apparatus in the image forming apparatus in FIG. 1.
Figure 4:
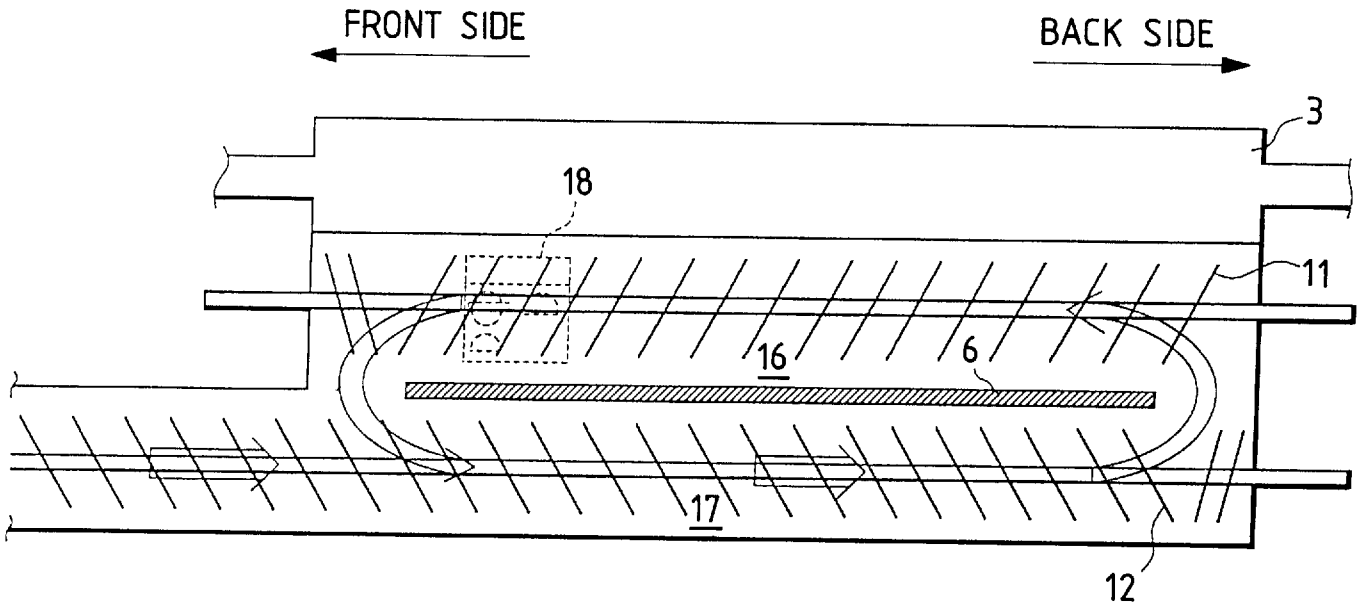
FIG. 4 is a plan view in the thrust direction of the two-component developing apparatus in FIG. 3.
Figure 5:
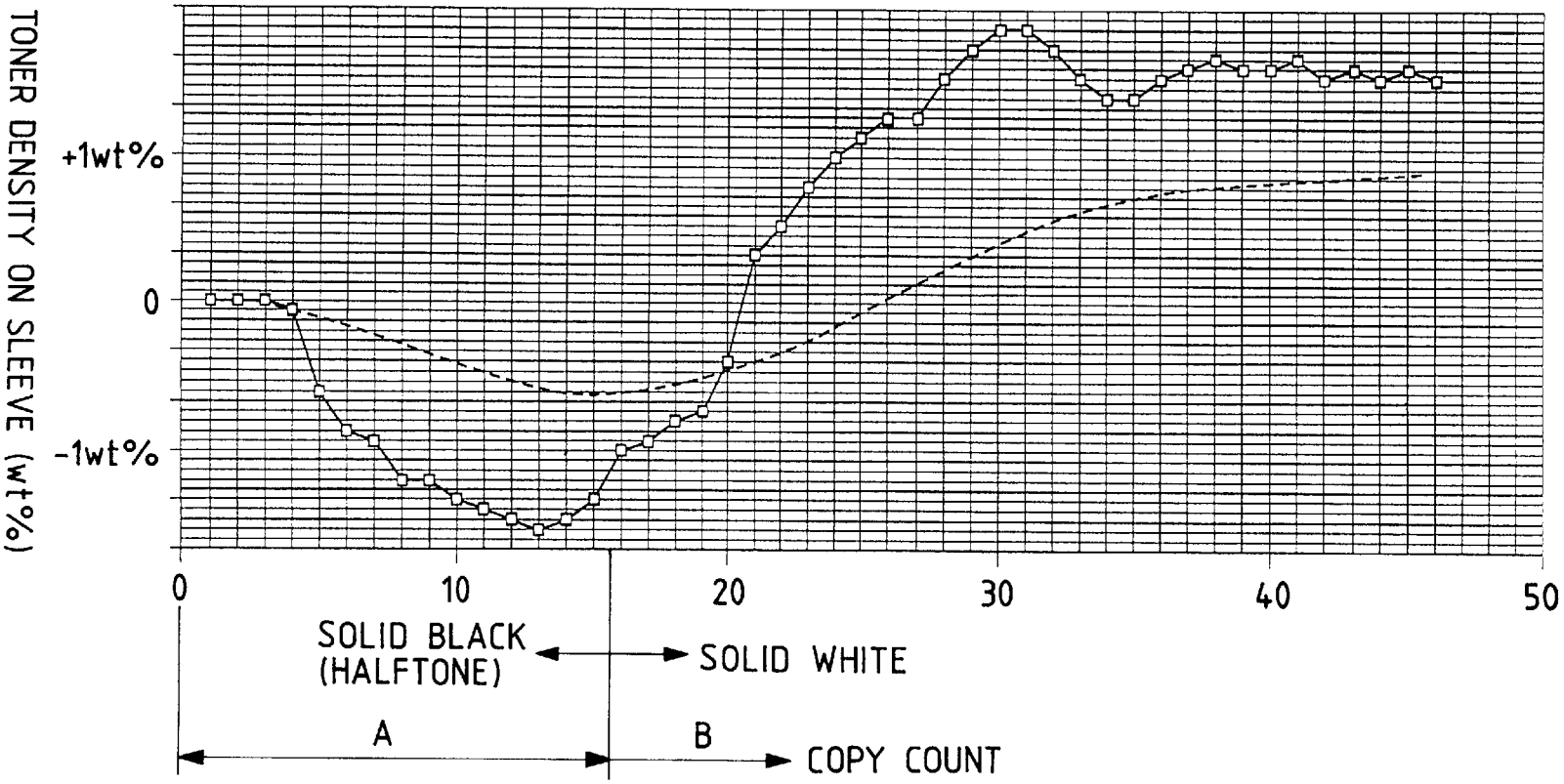
FIG. 5 is a graph showing a change in the developer density occurring when copying with a large change in the toner consumption amount continues.

As shown in FIG. 3, this image density sensing means is provided after the developing unit and the transfer member 49 of the image forming apparatus so as to oppose the photosensitive drum 4. Similar to the toner density sensing means 18 described above, the image density sensing means 19 consists of a bidirectional emission type LED 71*a*, a light-receiving element 72*a* for reference light, a light-receiving element 73*a* for reflected light, and a detection window 8*a*. A PFA sheet 81 for preventing adhesion of toner is stuck to the detection surface of the detection window 8*a*. With this construction, the image density sensing means 19 senses the reflection density of the patch image 28 on the photosensitive drum 4.

Figure 8:
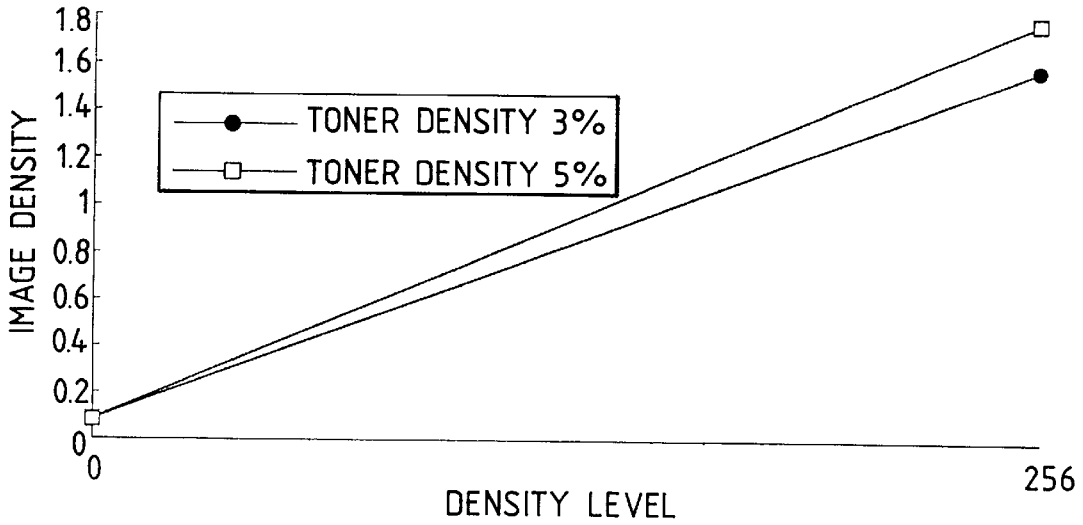
FIG. 8 is a graph showing the image density difference with respect to the toner density difference.

In the electrophotographic copying machine using the two-component developing apparatus, as illustrated in FIG. 8, the image density increases as the toner density of a developer increases. Furthermore, the image density sensing means 19 shows a sensing output as indicated by a curve B in FIG. 9 for the image density of each of magenta, cyan, and yellow on the photosensitive drum, and a sensing output as indicated by a curve A in FIG. 9 for the image density of black toner. Since the image density changes with a change in the toner density and the sensing output changes accordingly, the toner density can be controlled by the image density sensing means by using this change. That is, the patch image pattern 28 with a predetermined gradation density level is formed in each copy sequence, and the density of this image pattern on the photosensitive drum is read by the image density sensing means 19. When toner is consumed and the image density decreases, the sensing output from the image density sensing means 19 decreases for magenta, cyan, and yellow, and increases for black. In this embodiment, the output varied about 75 mV for color developers and about 150 mV for black with respect to a toner density change of 1 wt %. Thereby, the patch image is read immediately after the developer is supplied (in this embodiment the toner density is 6 wt %), and the sensing output at that time is stored as a reference level $V_{init}$ in the memory of the main body. A sensing output $V_{cur}$ for the patch image is compared with the level $V_{init}$ each time a copy is formed, and the difference is calculated.

$$\Delta V = V_{init}g - V_{cur}$$

On the basis of this equation, in the case of color, replenishment is performed when $\Delta V>0$, and no replenishment is performed when $\Delta V<0$. In the case of black, no replenishment is performed when $\Delta V>0$, and replenishment is performed when $\Delta V \leqq 0$. Let rate' be the above-mentioned output variation for a toner density change of 1 wt %. Then, a difference $\Delta D'$ from the initial toner density is calculated by $$\Delta D' = |\Delta V|/\text{rate}'$$

In this manner control is so performed as to maintain the initial toner density.

Unfortunately, the conventional density control methods have their respective drawbacks. That is, the developer reflection ATR cannot follow an abrupt change in the area of an image. The patch sensing ATR brings about developer overflow or defective coating if a large change is caused by triboelectricity.

In this embodiment, therefore, the density of the patch image 28 which is considered to best represent the toner density on the developing sleeve 3 is calculated by the patch sensing ART each time a copy is formed, and toner replenishment control is so performed that the density of the patch image is constant. However, this method may bring about developer overflow caused by toner density going up (in conventional systems this occurs due to a toner density going up of about 13 wt % although it depends upon the volume of a developing vessel), or defective coating on the developing sleeve caused by toner density going down (in conventional systems this occurs due to a toner density going down of about 3 wt % or lower). Therefore, a predetermined range of thresholds (e.g., an upper limit of 8% and a lower limit of 4%) is previously set for the sensing toner density of the toner density sensing means. While the toner density in the developing unit 9 is sensed by the developer reflection ATR which is performed at a predetermined timing during copying, the patch sensing ATR is performed within the predetermined range. If the toner density falls outside the predetermined range, the replenishment sequence using the patch sensing ATR is switched to the one using the developer reflection ATR. When the patch image density falls inside the predetermined range, the replenishment sequence using the developer reflection ATR is returned to the one using the patch sensing ATR.

As a result, toner replenishment control, which well follows a toner density change and is free of runaway is possible.

In the above embodiment, the patch sensing ATR is performed once for each copy or several copies. However, the patch sensing ATR is time-consuming as described earlier and therefore cannot sometimes be performed several times during continuous copying. If this is the case, the toner density is controlled within a certain range by performing replenishment by using the developer reflection ATR during continuous copying, and a lacking or excess toner amount is corrected by the subsequent patch sensing ATR. Consequently, it is possible to control the replenishment even during continuous copying during which the intervals of the patch sensing ATR are increased.

Another embodiment of the present invention will be described below.

Figure 10:
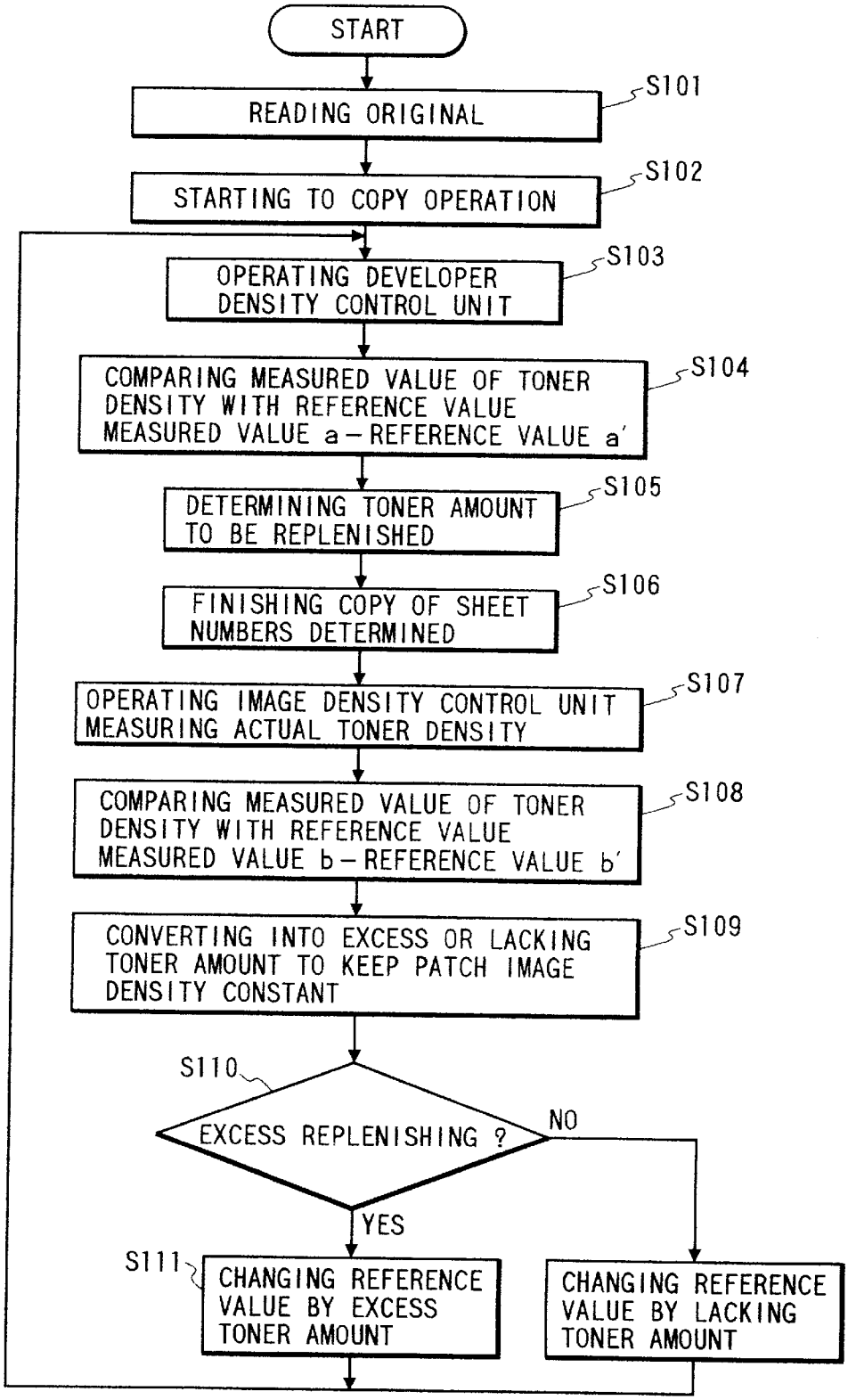
FIG. 10 is a flowchart showing another embodiment of the present invention.

FIG. 10 is a flowchart of this embodiment.

Figure 9:
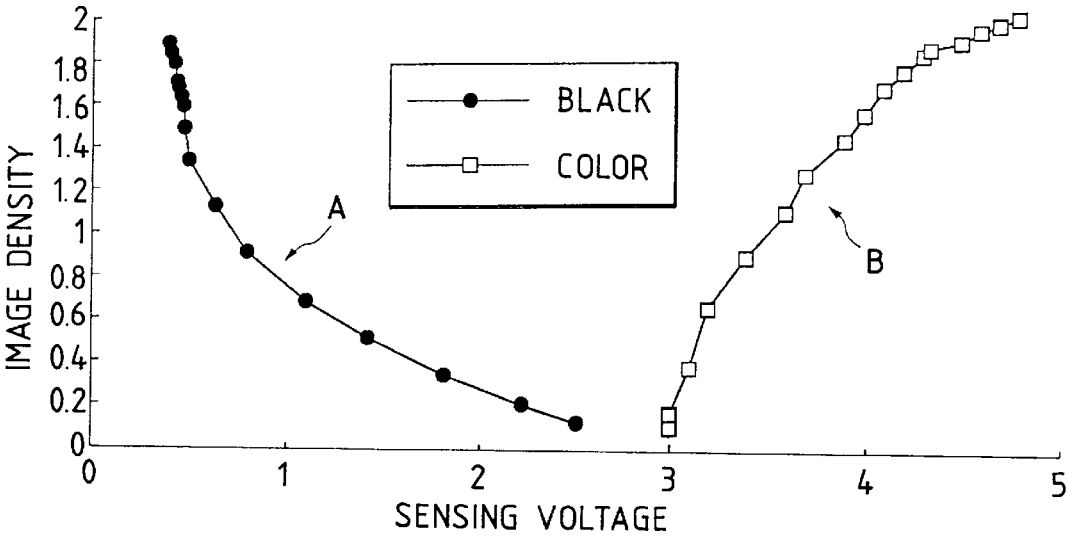
FIG. 9 is a graph showing a change in the image density as a function of the sensing voltage of the sensor.

In a two-component developing apparatus, the image density increases as the toner density of a developer increases as illustrated in FIG. 9. Furthermore, an image density sensing means 19 shows a sensing output as indicated by the curve B in FIG. 9 for the image density of each of magenta, cyan, and yellow (to be referred to as color developers hereinafter) on a photosensitive drum, and a sensing output as indicated by the curve A in FIG. 9 for the image density of black toner.

Accordingly, the density of a patch image 28, which is considered to best represent the toner density on a developing sleeve 3 is calculated by the patch sensing ATR. An excess or lacking toner amount obtained from the calculated image density is fed back to a current developer density obtained by the developer reflection ATR, thereby preventing runaway. More specifically, assuming the toner density of an initial developer (470 g magnetic carrier +30 g toner) is 6 wt %, the patch sensing ATR is performed while toner is replenished such that the toner density is controlled to 6 wt % on the basis of an output from a toner density sensing means. If the image density decreases from the initial density and it is determined that 5 g of toner are necessary to restore the initial density, it is considered that the developer density is −1 wt %. Accordingly, the target value of the developer reflection ATR is changed from 6 wt % to 7 wt %, and the developer reflection ATR is performed with this target value. Consequently, the image densities can be converged to a fixed image density level.

Note that a toner density higher or lower than a certain level may bring about developer overflow or defective coating. This problem can be solved by setting certain thresholds in the toner density level. That is, when a signal from the developer reflection ATR reaches the threshold, the control by the patch sensing ATR is stopped, and the replenishment is switched to the one done only by the developer reflection ATR. During the operation the target values of the developer reflection ATR can be fixed to upper- and lower-limit values. When a signal from the patch sensing ATR requests the control within the thresholds, the target values of the developer reflection ATR are changed. Consequently a good density transition can be obtained.

The preferred embodiments of the present invention have been described above. However, the present invention is not limited to these embodiments and any modification is possible without departing from the spirit and scope of the invention.

What is claimed is:

1. An image forming apparatus comprising:

an image carrier for carrying an electrostatic image;

a developing unit for developing the electrostatic image on said image carrier with a developer consisting of toner and carrier;

replenishing means for replenishing the toner to said developing unit;

ratio sensing means for sensing a ratio of the toner to the carrier in said developing unit;

image density sensing means for sensing a density of the developed toner image; and selecting means for selecting a first toner replenishment mode in which an amount of toner based on a sensing output from said image density sensing means is replenished by said replenishing means when the sensed output from said ratio sensing means falls within a predetermined range, a second toner replenishment mode in which an amount of toner based on a sensing output from said ratio sensing means is replenished by said replenishing means when the sensed output from said ratio sensing means falls outside the predetermined range.

2. An apparatus according to claim 1, wherein said ratio sensing means comprises a light source for emitting light toward the developer and a light-receiving element for receiving light reflected by the developer.

3. An image forming apparatus comprising:

an image carrier for carrying an electrostatic latent image;

a developing unit for developing the electrostatic latent image on said image carrier with a developer consisting of toner and carrier;

ratio sensing means for sensing a ratio of the toner to the carrier in said developing unit;

replenishing means for replenishing the toner to said developing unit on the basis of an output from said ratio sensing means so that the ratio of the toner to the carrier becomes a predetermined target value;

density sensing means for sensing a density of a developed reference toner image; and determining means for determining the target value on the basis of the density sensed by said density sensing means, wherein said ratio sensing means comprises a light source for emitting light toward the developer and a light-receiving element for receiving light reflected by the developer.

4. An apparatus according to claim 3, wherein said determining means determines the target value on the basis of a density of a reference toner image formed after said replenishing means replenishes the toner.

* * * * *

UNITED STATES PATENT AND TRADEMARK OFFICE

CERTIFICATE OF CORRECTION

PATENT NO. : 5,819,132

DATED : October 6, 1998

INVENTOR(S) : FUMITAKE HIROBE

It is certified that error appears in the above-identified patent and that said Letters Patent is hereby corrected as shown below:

COLUMN 3:

Line 11, "occurs " should be deleted;
Line 16, "occurs " should be deleted; and
Line 30, "is" (second occurrence) should be deleted.

COLUMN 5:

Line 64, "1" should read --1,--.

COLUMN 6:

Line 55, "voltage" should read --voltage,--.

Signed and Sealed this

First Day of June, 1999

*Attest:*

Q. TODD DICKINSON

*Attesting Officer*

*Acting Commissioner of Patents and Trademarks*